United States Patent [19]

Hallmark

[11] 4,292,842

[45] Oct. 6, 1981

[54] TOOL FOR TESTING EARTH FORMATIONS IN BOREHOLES

[75] Inventor: Bobby J. Hallmark, Fort Worth, Tex.

[73] Assignee: Gearhart Industries, Inc., Fort Worth, Tex.

[21] Appl. No.: 146,702

[22] Filed: May 5, 1980

Related U.S. Application Data

[62] Division of Ser. No. 42,431, May 25, 1979, Pat. No. 4,270,385.

[51] Int. Cl.[3] ..... E21B 49/00

[52] U.S. Cl. ..... 73/155

[58] Field of Search ..... 73/155, 151; 166/250, 166/264, 279

[56] References Cited

U.S. PATENT DOCUMENTS 3,577,782 5/1971 Aitken ..... 73/155

3,782,191 1/1974 Whitten ..... 73/155

*Primary Examiner*—Jerry W. Myracle

*Attorney, Agent, or Firm*—James M. Peppers; Donald H. Fidler; James H. Dautremont

[57] ABSTRACT

A tool for testing earth formations in bore-holes provides a failsafe function for retracting the sealing pad of the formation isolation device, in the form of elements operable in response to failure of down-hole power supply for the tool to effect release of hydraulic setting pressure on the seal pad. The tool further provides a formation mini-sample chamber of variable volume with elements permitting aboveground monitoring and control of same independently of any other tool function. The mini-sample chamber control device also controls the operation of a formation fluid sample flow line valve. The tool is divided into upper and lower pivotable sections to alleviate the problem of becoming differentially stuck. A unique pivot structure incorporating sample chamber seal valve assembly, is provided. A unique sand screen device is provided to permit the tool to function when working with unconsolidated formations.

2 Claims, 9 Drawing Figures

TOOL FOR TESTING EARTH FORMATIONS IN BOREHOLES

CROSS-REFERENCE

This is a division of Ser. No. 042,431, filed May 25, 1979 now U.S. Pat. No. 4,270,385.

BACKGROUND OF THE INVENTION

1. Field of the Invention

The present invention relates to tools for testing earth formations in boreholes and more particularly for making formation pressure measurements, acquiring information concerning formation permeability and productivity, and retrieving samples of formation fluids.

2. Description of the Prior Art

Formation testing tools of the prior art of which I am aware have a number of deficiencies. It is important that such tools should have an effective fail-safe arrangement to assure that the parts that are extended into contact with the formation when the tool is set can be retracted in the event of power failure, so that the tool can be removed from the borehole. The fail-safe arrangements of the prior art that I know of are actuated by a tensioning of the tool suspension cable to shear a pin or the like, and are subject to problems such as unintentional shearing of the pin, or inability to exert the requisite tensioning force due to cable key seating.

Formation testing tools conventionally provide a pre-test chamber or chambers into which a small quantity of formation fluid (typically about 20 c.c.) can be drawn in order to make formation shut in pressure measurements and obtain indications of formation permeability and potential production. Once the pre-test procedure has been initiated, the entire pre-test chamber capacity must be filled with formation fluid before shut in pressure can be determined, which in the case of low permeability formations can consume considerable time. In addition, the lack of control between the initiation and completion of the pre-test procedure precludes desirable flexibility.

Formation testing tools are typically quite long, and a considerable portion of their length is in the sample chamber portion, which is conventionally rigidly attached below the seal pad. While the tool is set, or when attempting to free the tool, this sample chamber portion can be jammed against the wall of the borehole and become differentially stuck.

Formation testing tools of the prior art that I know of have had problems in maintaining isolation of the formation at the seal pad when testing in unconsolidated formations.

Patents that exemplify prior art formation testing tools are U.S. Pat. Nos. 3,811,321, 3,813,936, 3,858,445, 3,859,850, 3,859,851, 3,864,970, 3,924,468, and 3,952,588.

SUMMARY OF THE INVENTION

A first objective of the present invention is to provide an improved failsafe arrangement to ensure the retracting of the seal pad means and backup pad means in the event of equipment malfunction. This is accomplished by providing electrically powered means controllable at aboveground equipment for generating and applying hydraulic setting pressure to extend and set the seal pad means and backup pad means; means for generating signals to be transmitted to above ground equipment, which signals are a measure of the hydraulic setting pressure, and power supply means for the signal generating means; and means operable in response to a failure of the power supply means to effect release of the hydraulic setting pressure and permit retraction of the seal pad means and backup pad means. In one aspect of the invention, the electrically powered means comprises a reversible electric motor coupled to driving means for moving a piston longitudinally of a cylinder which contains hydraulic fluid, and fluid passage means communicating between the cylinder and the seal pad means and backup pad means; and an electromagnetic clutch interposed in the driving means and operable in response to a failure of the power supply means to disengage the driving means. In a further aspect of the invention, the driving means comprises first and second gear reductions and a ball screw and ball nut, with the piston moveable with the ball nut; the electromagnetic clutch is interposed between the first and second gear reductions and has an energizing coil; the energizing coil being connected in series with the power supply means for the signal generating means; and spring bias means within the cylinder and exerting a force on the piston sufficient to overcome the frictional forces present in the ball screw and ball nut and second gear reduction when the electromagnetic clutch is de-energized, such that the piston is moved in the direction to increase the hydraulic fluid volume within the cylinder, thereby effecting release of the hydraulic setting pressure and permitting retraction of the seal pad means and backup pad means.

Another objective of the invention is to provide improved apparatus for achieving formation "shut-in" pressure measurements and for obtaining indications of formation permeability and potential production, and for obtaining formation fluid samples. The improved apparatus provides a formation fluid mini-sample chamber having variable volume, and fluid passage means for communicating between the mini-sample chamber and the formation at the seal pad location; electrically powered means controllable at aboveground equipment to vary at the will of an operator the volume of the mini-sample chamber; means for generating signals to be transmitted to aboveground equipment, which signals are a measure of fluid pressure within the mini-sample chamber; and means for generating further signals to be transmitted to aboveground equipment, which further signals are a measure of the volume of the mini-sample chamber. In accordance with a further aspect of the invention, the electrically powered means comprises a reversible electric motor coupled through a gear reduction to a ball screw and ball nut; with the variable volume mini-sample chamber comprising a cylinder having a sealed upper end and being moveable with the ball nut; a floating piston is disposed within the cylinder and is pressure biased so as to normally close fluid passage means communicating between the formation at the seal pad location and a formation sample chamber; and means are provided to move the floating piston upwardly to open the last mentioned fluid passage means upon a predetermined upward movement of the cylinder. Another objective of the invention is to provide structure to alleviate the problem of sticking the tool in the borehole. The tool is made up of upper and lower elongated tool body sections and a pivot structure is provided connecting the lower end portion of the upper body section to the upper end portion of the lower body section for limited pivoting movement, with the axis of the pivoting movement being normal to the direction of movement of the seal pad means for extension and retraction. In another aspect of the invention, this pivot structure incorporates a seal valve for the formation sample chamber which is located in the lower tool body section. In accordance with another aspect of the invention, the seal valve comprises a body portion having a cylindrical exterior surface which acts as the pivot pin or journal for the pivot structure. In a further aspect of the invention, the valve body portion has cylindrical interior portions which carry respective first and second pistons disposed at opposite ends of a piston rod; formation fluid passage means communicates between the formation at the seal pad location and the formation sample chamber via the cylindrical interior portion, with the first piston interposed in the passage and movable to open or close the passage; hydraulic fluid passage means communicates between the means for generating and applying setting pressure to the seal pad means and the second piston; and spring bias means is provided to urge the first piston in the direction to close the formation fluid passage. In accordance with a still further aspect of the invention there is provided a third piston reciprocable within a cylinder which on one side of the third piston is open to the exterior of the tool and which on the other side is open to the valve body cylindrical interior portion which carries the first piston, such that force exerted on the third piston in the direction of closing the seal valve is mechanically transmitted to the first piston, while force exerted on the third piston in the direction of opening the seal valve is independent of the first piston.

Another objective of the invention is to provide improved means for maintaining isolation of the formation at the seal pad location when testing in unconsolidated formations. This improved means comprises formation isolation means including hydraulically controlled extendable and retractable seal pad means and backup pad means; the extendable and retractable seal pad means comprising a seal pad, first piston means having a central bore and fixed to the seal pad, said first cylinder means sealingly engaged by said first piston means; closure means sealingly closing the outer end of the first cylinder means and having a central cylindrical bore; a sand screen assembly comprising an elongated piston shaft, sand screen spring means, and piston shaft return bias means; the elongated piston shaft having a first end portion sealingly engaging the closure means central cylindrical bore and movable longitudinally thereof and a first end face, with the first end face being exposed to the well bore annulus when the tool is in operation; the seal pad means having a central opening communicating between the central bore of the first piston means and the earth formation to be tested when the seal pad is set in a well bore; the elongated piston shaft having a second end portion mating with the seal pad central opening and moving longitudinally thereof, and a second end face, with the second end face abutting the earth formation to be tested when the seal pad is set in a well bore; the sand screen spring means comprising a spirally wound spring having numerous turns that are normally separated sufficiently to permit flow of formation fluids as well as sand therethrough, with the inner diameter of the spring loosely mating with the exterior surface of the elongated piston shaft, and means fixing the spring at its outer end portion to the seal pad, with the free portion of the spring extending inwardly along the piston shaft; passage means communicating between the piston shaft second end face and its exterior surface along the length of the spring and beyond the inner end of the spring; abutment means fixed to said piston shaft adjacent the inner end of said passage means, for engaging the spring upon predetermined movement of the piston shaft outwardly toward the earth formation; such that the passage means can become limited to the spaces between the turns of the spring, which spaces are limited to the diameters of sand particles trapped therebetween. In a further aspect of the invention, the passage means are flutes in the exterior surface of the piston shaft. In a further aspect of the invention, the abutment means is a collar fixed to the piston shaft at the inner end of the flutes and mating with or integral with the exterior surface of the piston shaft.

DESCRIPTION OF THE PREFERRED EMBODIMENTS

Figure 1:
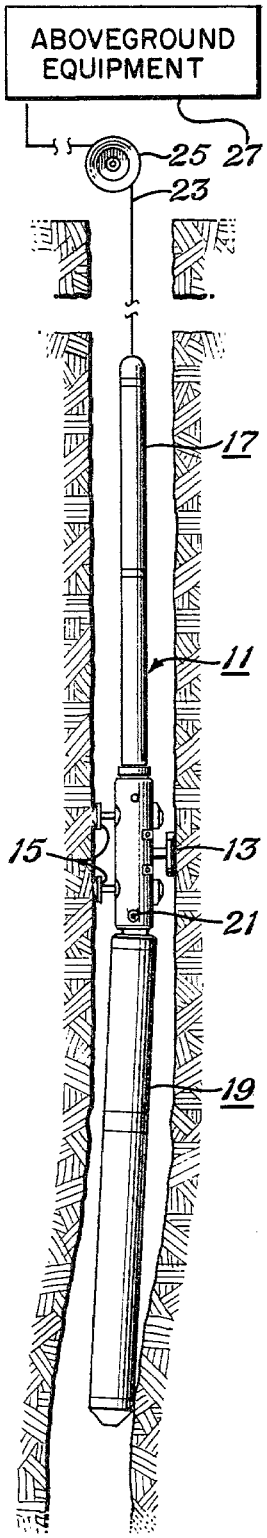
FIG. 1 is a schematic diagram showing the tool of the present invention suspended in a borehole, with above ground equipment shown as a block.

In FIG. 1 there is shown a tool 11 of the present invention suspended in a borehole at the location of a formation to be tested, with a seal pad 13 and backup pads 15 in the set condition. The tool 11 is made up of two primary sections which may be termed the upper tool section 17 and the lower tool section 19. As will be hereinafter more fully explained, the lower section 19 is pivotally connected to the upper section 17 so as to provide limited relative pivoting movement about an axis 21 which is normal to the direction of travel of the seal pad 13 and backup pads 15 when they are being extended or retracted. The cable 23 and winch means 25 by which the tool 11 is suspended and traversed along the borehole, as well as the aboveground equipment shown as a block 27, are conventional, and consequently, need not be described in detail herein.

FIGS. 3–7 show the entire tool 11 in a series of schematic longitudinal section views, with all parts shown as they would be as the tool 11 is being run into the borehole.

The body of the upper tool section 17 may be regarded as made up of several elements, which observing from top to bottom in FIGS. 3–6, are a head sub 29, upper pressure jacket 31, pressure jacket connector sub 33, lower pressure jacket 35, pad block sub 37, and pad block 39.

The head sub 29 is threaded at its upper end portion for connection to a conventional cable head (not shown) and is threaded at its lower end portion for connection to the upper end of the upper pressure jacket 31. Suitable conventional cable connectors 41 are provided to make the electrical connections from the cable head through the head sub 29 to the interior of the upper pressure jacket 31. Since the manner of making the necessary electrical connections in the tool is a matter of conventional practice, the details of such connections are not shown or described herein. The lower end of the upper pressure jacket 31 is threadedly connected to the upper end of the pressure jacket connector sub 33. The upper end of the lower pressure jacket 35 mates in sliding engagement with the exterior surface of the pressure jacket connector sub 33 and is secured thereto by bolts. The lower end of the lower pressure jacket 35 is threadedly connected to the upper end of the pad block sub 37 and the upper end of the pad block 39 is fixed to the lower end of the pad block sub 37 by threaded compression connector means. O-rings 105 are provided at suitable locations at the connections of the body elements of the upper tool section 17 to seal out well bore fluids.

Apparatus for generating and controlling hydraulic pressure to extend and set seal pad means and backup pad means and to release same, may be referred to as the hydraulic power assembly. The hydraulic power assembly is contained within the portion of the upper tool section 17 shown by FIGS. 3 and 4, and comprises an electric motor 43, a first gear reduction 45, an electromagnetic clutch 47, a second gear reduction 49, a ball screw and ball nut assembly 51, and a hydraulic piston and cylinder assembly 53.

The hydraulic power assembly is supported within the upper pressure jacket 31 by the pressure jacket connector sub 33. A primary cylinder 55 of the hydraulic piston and cylinder assembly 53 is threadedly connected at its lower end to the upper end of the pressure jacket connector sub 33 and is threadedly connected at its upper end to the lower end of a bearing assembly retainer structure 57, which in turn is threadedly connected at its upper end to the lower end of a first cylindrical frame structure 59, which is fixed by bolts at its upper flanged end to the lower flanged end of a second cylindrical frame structure 61, which has an upper flanged end. The electric motor 43 (sometimes referred to herein as the setting motor) and its associated first gear reduction 45 are mounted on and fixed by bolts to the upper flanged end of the second cylindrical frame structure 61, with the first gear reduction 45 protruding into the interior of the second cylindrical frame structure 61.

The electric motor 43 drivingly engages the first gear reduction 45 which is connected by coupling means 63 to one side of the electromagnetic clutch 47, the other side of which is connected by coupling means 65 to one side of the second gear reduction 49, which in turn is connected on its other side by coupling means 67 to the upper end of a bearing hub 69 of the ball screw and ball nut assembly 51.

The electric motor 43 is a reversible 110 volt direct current motor which may typically be of the type manufactured by Globe Industries, Inc., of Dayton, Ohio, model number M100M13. Typically, the first gear reduction 45 may be 14:1 and the second bear reduction 49 may be 55:1. the electromagnetic clutch 47 may typically be of a type manufactured by Magtrol, Inc., of Buffalo, New York, model number FC1090313.

The hydraulic piston and cylinder assembly 53 comprises the primary cylinder 55, a secondary cylinder 71, a setting piston 73 and a setting piston return spring 75. The secondary cylinder 71 is disposed within a central bore 77 of the pressure jacket connector sub 33; is fixed therein by a retainer 79 which threadedly engages the lower end of the central bore 77, and protrudes downwardly beyond the retainer 79. The setting piston 73 has a head 81 which sealingly mates with the interior surface 83 of the primary cylinder 55, and an integral tubular extension 85 which protrudes into said secondary cylinder 71 and sealingly engages the interior surface 87 of the secondary cylinder 71 adjacent to entrance thereto. The setting piston 73 has a central bore 89 which extends throughout its length.

The ball screw and ball nut assembly 51 comprises the bearing assembly retainer structure 57, the bearing hub 69, a ball screw 91 and a ball nut 93. The bearing hub 69 is secured by suitable means for rotation within the bearing assembly retainer structure 57 and has a threaded upper extension portion 95 upon which there is mounted an actuator nut 97 which carries a limit switch actuator 99. The travel of the actuator nut 97 is related to the travel of the setting piston 73 so as to limit the latter in both upward and downward directions by actuating a respective limit switch 101, 103 to open the circuit to the setting motor 43. The ball screw 91 is fixed at its upper end to the lower end of the bearing hub 69 and extends downwardly the full length of the primary cylinder 55 and protrudes partially into the setting piston central bore 89. The ball nut 93 engages the ball screw 91 and is threadedly fixed at its lower end to the head 81 of the setting piston 73. The setting piston return spring 75 bears at its upper end against the bearing assembly retainer structure 57 which closes the upper end of the primary cylinder 55, and bears at its lower end on the head 81 of the setting piston 73.

Apparatus for conducting various formation tests and for providing and controlling flow valve means may be referred to for convenience as the mini-sample apparatus. The mini-sample apparatus is contained within the portion of the upper tool section shown by FIGS. 5 and 6, and comprises an electric motor 107, a gear reduction 109, a ball screw and ball nut assembly 111, and a mini-sample cylinder and piston assembly 113.

The mini-sample apparatus is supported within the lower pressure jacket 35 by the pad block sub 37. A third cylindrical support structure 115 is threadedly connected at its lower end to the upper end portion of the pad block 39 and is threadedly connected at its upper end to the lower end of a fourth cylindrical support structure 117. The electric motor 107 (sometimes referred to herein as the mini-sample motor) and its associated gear reduction 109 are mounted on and fixed by bolts to the upper end of the fourth cylindrical support structure 117, with the gear reduction 109 protruding into the interior of the fourth cylindrical support structure 117.

The electric motor 107 drivingly engages the gear reduction 109 which is connected by coupling means 119 to the upper end of a bearing hub 121 of the ball screw and nut assembly 111.

The mini-sample electric motor 107 may be of the same type as the setting motor 43. Typically, the mini-sample motor gear reduction 109 may be 445:1.

The mini-sample piston and cylinder assembly 113 comprises a primary piston structure 123, a primary cylinder 125, a floating piston 127, and a flow line valve body 129. The primary piston structure 123 comprises a piston head portion 131 and a cylindrical housing portion 133 having first and second central bores 135, 137. The piston head portion 131 is threadedly connected to the lower end of the cylindrical housing portion 133 which is also the lower end of the first central bore 135. The piston head portion 131 is reciprocable within the primary cylinder 125 formed by a central bore in the lower end of the pad block sub 37. The upper end of the first central bore 135 is sealingly closed by a pressure sensor adapter 139. The second central bore 137 has a threaded connection at its upper end to the ball nut 141 of the ball screw and ball nut assembly 111, and the second central bore 137 receives the ball screw 143 of the ball nut and screw assembly 111 as the ball nut 141 is moved upwardly.

The flow line valve body 129 is a generally cylindrical structure having a flanged upper end portion merging with an exterior threaded portion which in turn merges with cylindrical exterior sealing surfaces. The flow line valve body has a central bore 145, an annular exterior groove 147 disposed between said sealing surfaces, and flow passages communicating between the annular groove 147 and the central bore 145. The pad block 39 is provided a bore 149 for threadedly receiving said flow line valve body 129 and matingly receiving said sealing surfaces.

The floating piston 127 has a head portion 151 in sealing engagement with and reciprocable within the first central bore 135 of the primary piston structure 123 and an integral downwardly extending tubular extension 153 having an exterior sealing surface 155 at its lower end portion which is matingly received by the flow line valve body central bore 145. The upper surface of the floating piston head portion 131, the lower surface of the pressure sensor adapter 139 and the portion of the primary piston structure first central bore 135 between these surfaces formed a mini-sample chamber 159 having variable volume, as will be hereinafter explained. The floating piston 127 has a fluid passage 161 communicating between the mini-sample chamber 159 and the lower end of the pad block bore 149.

The ball screw and ball nut assembly 111 comprises a bearing assembly retainer structure 157, the bearing hub 121, the ball screw 143, and the ball nut 141. The bearing hub 121 is secured by suitable means for rotation within the bearing assembly retainer structure 157. The ball screw 143 is fixed at its upper end to the lower end of the bearing hub 121 and extends downwardly through the ball nut 141.

A limit switch actuator 163 is mounted on the primary piston structure 123 and is movable with the ball nut 141 between upper and lower limit switches 165, 170. The limit switches 165, 170 are connected in the power supply circuit of the mini-sample motor 107 so as to stop the motor when actuated. Thus, the travel of the ball nut 141 (and hence the primary piston structure 123) is limited.

A series of longitudinally extending cam notches 169 are provided on the exterior surface of the upper end portion of the primary piston structure for coaction with the cam actuator 171 of a microswitch 173 which is mounted to the third cylindrical support structure 115. The microswitch 173 produces an output pulse each time the cam actuator 171 traverses a cam notch 169. Each cam notch 169 represents an increment of mini-chamber 159 volume (typically 2 c.c.).

The tool 11 has an electronics section 175 comprising various components mounted on a chassis 177 located in a space between the upper end of the mini-sample motor 107 and the lower end of the secondary cylinder 71 of the hydraulic piston and cylinder assembly 53. The electronics section chassis 177 is secured at its upper end to the lower end portion of the secondary cylinder 71.

A hydraulic fluid or seal pad setting pressure sensor 179 is mounted in the end of the secondary cylinder 71. A formation fluid pressure sensor 181 is mounted in the pressure sensor adapter 139 of the mini-sample apparatus.

Power (110 volts direct current) is supplied from the aboveground equipment via cable 23 and connectors 41 separately to each of the setting motor 43 and the mini-sample motor 107 in series with respective limit switches 101, 103 and 163, 165, so that each motor 43, 107 can be separately controlled by the aboveground operator. Power (26 volts direct current) is also supplied from the aboveground equipment to the electronics section 175, in series with the energizing coil of the electromagnetic clutch 47, so that the electromagnetic clutch 47 is de-energized to disengage when and if there is a failure in the 26 volt direct current power supply. The electronics section 175 includes a power supply and amplifiers for the pressure sensors 179, 181 and also a power supply and amplifier for the circuit of microswitch 173. Output signals from each pressure sensor amplifier and the microswitch circuit amplifier are transmitted to the aboveground equipment via the cable 23. Since the electronics section, the power supply conductors and various electrical connections are matters within the scope of conventional practice, these are not shown or described in detail herein.

An inner cylindrical jacket 183 is received within the lower pressure jacket 35 and is matingly and sealingly received at its upper end by a cylindrical external surface portion 185 of the pressure jacket connector sub 33 and is further matingly and sealingly received at its lower end by an exterior cylindrical surface 187 at the upper end of the pad block sub 37.

The pad block 39 carries a sealing pad assembly 189, upper and lower backup pad assemblies 191, 193 and an equalizer valve assembly 195.

The sealing pad assembly 189 comprises a sealing pad 197, sealing pad retainer 199, sealing pad plate 201, upper and lower sealing pad guide rods, 203, 205, sealing pad piston 207, sealing pad piston plug 209, and sealing pad cylinder 211. The sealing pad 197 is made of a resilient material such as rubber, which typically may be 60–90 durometer nitrile rubber, and has a generally rectangular shape, with some curvature in transverse section so as to generally conform to the borehole wall curvature. The sealing pad plate 201 is a metal plate that can cover a large portion of the inner surface of the sealing pad 197. The upper and lower sealing pad guide rods 203, 205 are secured by bolts to the sealing pad plate 201 adjacent its respective upper and lower edges and are reciprocable in respective mating bores (not shown) in the pad block 39. The sealing pad retainer 199 is generally cylindrical having a flanged outer end, a cylindrical exterior portion 200 matingly received by a sealing pad central bore, and an exterior threaded portion at its inner end which engages internal threads at the outer end of the sealing pad piston 207. When the sealing pad retainer 199 is in place, the sealing pad 197 is clamped between the retainer flanged outer end and the sealing pad plate, and the sealing pad plate is clamped between the sealing pad inner surface and the outer end face of the sealing pad piston 207. Thus, the sealing pad 197 and sealing pad plate 201 are securely fixed relative to the sealing pad piston 207.

The sealing pad retainer 199 has a cylindrical bore 202 at its inner end portion which merges with a threaded intermediate bore 204 of smaller diameter which in turn merges with an outer end bore of still smaller diameter, for a purpose to be hereinafter explained. The sealing pad piston 207 has a first exterior cylindrical surface 206 that extends over about half its length from the center portion outwardly toward the sealing pad 197 and a second cylindrical exterior surface 208 of smaller diameter extending from the center portion inwardly to the inner end. The sealing pad piston 207 has a cylindrical central bore 210 extending between the internal threads 222 at the outer end portion and internal threads 224 at the inner end portion, which cylindrical central bore 210 merges with and has the same diameter as the cylindrical bore 202 at the inner end of the sealing pad retainer 199.

The pad block 39 has a central transverse bore 213 having a first cylindrical portion 212 matingly and sealingly receiving the first exterior cylindrical surface of the sealing pad piston 207 and merging with a second cylindrical portion 214 of increased diameter for providing a fluid flow passage to and around the sealing pad piston 207, and merging with a third cylindrical portion 216 of further increased diameter for receiving a cylindrical exterior portion of the sealing pad cylinder 211, and merging with a fourth cylindrical portion 218 of further increased diameter for matingly and sealingly receiving a second cylindrical exterior portion of the sealing pad piston 207, and merging with a fifth cylindrical threaded portion 220 of further increased diameter for receiving a threaded exterior portion of the sealing pad cylinder 211.

The sealing pad piston plug 209 has a cylindrical exterior portion 215 that matingly and sealingly engages a first cylindrical interior surface 217 of the sealing pad cylinder 211 and merges with a threaded cylindrical portion 219 of reduced diameter which engages the threads 224 at the inner end portion of the sealing pad piston 207. The threaded cylindrical portion 219 has a plurality of longitudinally extending grooves 221 which extend to communicate with corresponding lateral bores 223 to provide fluid passages between the second exterior cylindrical surface 208 of the sealing pad piston 207 and its interior. The sealing pad cylinder 211 has a second interior cylindrical surface 225 of lesser diameter than the first cylindrical interior surface 217 and which matingly and sealingly engages the second exterior cylindrical surface 208 of the sealing pad piston 211. A shoulder 227 on the exterior surface of the sealing pad piston at the juncture of the first and second exterior cylindrical surfaces 206, 208 of the sealing pad piston 211 abuts the inner end surface of the sealing pad cylinder 211 to provide a stop for the sealing pad piston 211 in the retracting direction.

The upper backup pad assembly 191 comprises a piston shaft 229, a backup pad 231, a seal plug 233, and a guard pad 235. A transverse bore 237 in the pad block 39 receives the piston shaft 229 and seal plug 233. The backup pad 231 is made of metal; is generally disc shaped; and is fixed to the outer end of the piston shaft 229. The seal plug 233 is fixed to the pad block 39 at the entrance to the transverse bore 237 by threads 239 and has a circumferential groove 241 in its exterior surface to provide a fluid passage. The piston shaft 229 matingly and sealingly engages a first interior cylindrical portion 243 of the seal plug 233 located at the seal plug outer end portion; which interior cylindrical portion 243 merges with a second interior cylindrical portion 245 of greater diameter, which second interior cylindrical portion 245 in turn merges with an interior cylindrical portion 247 of the transverse bore 237. The guard 235 is sealingly fixed to the pad block exterior surface by bolts and serves to protect the sealing pad 197. The guard pad 235 has a central cavity 249 which receives the inner end portion of the piston shaft 229.

The lower backup pad assembly 193 is like the upper backup pad assembly 191 except that its seal plug 251 does not incorporate circumferential groove 241 and consequently does not provide the associated fluid passage.

The equalizer valve assembly 195 comprises a piston 253, a seal ring 255, a retainer plug 257 and a bias spring 259. The pad block 39 is provided a bore 261 for receiving the equalizer valve assembly 195. The piston 253 matingly and sealingly engages adjacent its inner end a portion 263 of the pad block bore 261 and adjacent its outer end a central bore 265 of the seal ring 255. The inner end of the piston is exposed to a hydraulic fluid flow passage, while the outer end is exposed to well bore fluid. The retainer plug 257 threadedly engages the outer end portion of the pad block bore 261 to hold the seal ring 255 in place within a portion of the pad block bore 261. The bias spring 259 bears at one end on the seal ring 255 and at the other end on a shoulder on the piston 253, so as to urge the piston inwardly for a purpose to be hereinafter explained.

Figure 7:
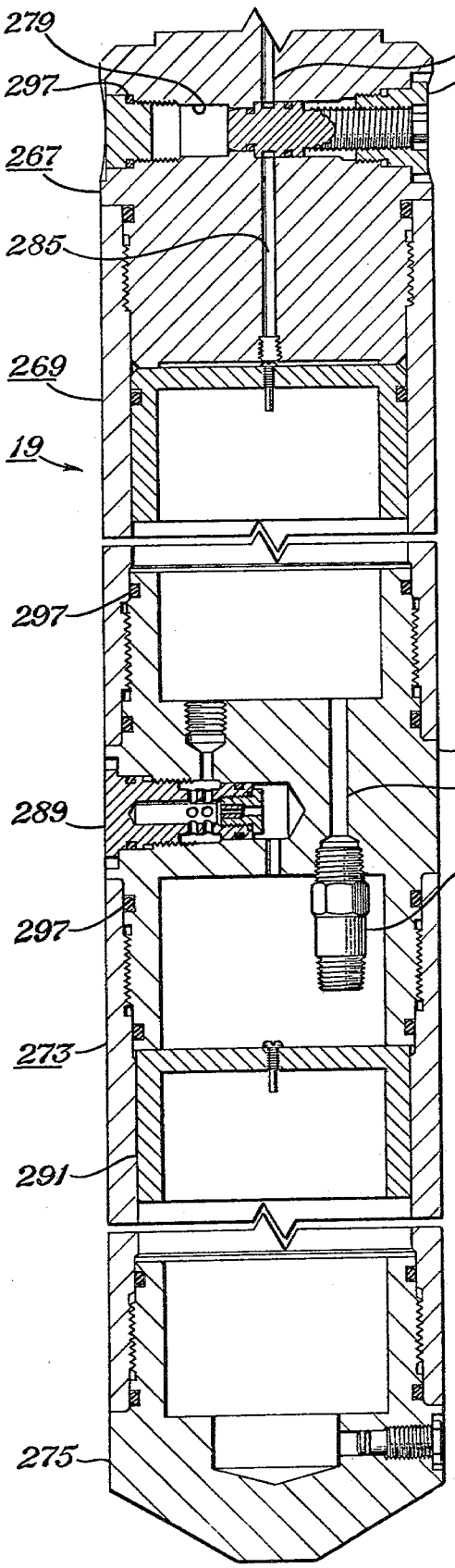

The lower tool section 19, with the exception of the pivot assembly 277, is of a conventional design and consequently will be described only briefly herein. The body of the lower tool section 19 may be regarded as made up of several elements, which, observing from top to bottom in FIG. 7, are a bleed off sub 267, a formation sample chamber 269, a chamber connector sub 271, a cushion chamber 273, and a bull plug 275.

The bleed off sub 267 is threadedly connected at its lower end portion to the upper end portion of the formation sample chamber 269 which is threadedly connected at its lower end portion to the upper end portion of the chamber connector sub 271 which is threadedly connected at its lower end portion to the upper end portion of the cushion chamber 273 which is threadedly connected at its lower end portion to the bull plug 275.

The bleed off sub 267 has a transverse bore 279 which on one side carries a seal plug 281 and on the other side carries a bleed off valve 283. A formation sample fluid passage 285 in the bleed off sub communicates from the pivot assembly 277 via the bleed off valve 283 to the volume of the sample chamber interior above a sample chamber piston 287. The sample chamber volume below the sample chamber piston 287 contains water which is forced via a choke assembly 289 carried by the chamber connector sub 271 into the volume of the cushion chamber 273 above a cushion chamber piston 291, as the sample chamber piston 287 is moved downwardly. The cushion chamber volume below the cushion chamber piston 291 contains air. A separate fluid passage 293 communicates between the lower end of the formation sample chamber 269 and the upper end of the cushion 273 via the chamber connector sub 271 and a check valve 295. Suitable seals are provided within the lower tool section by various O-rings 297.

Figure 8:
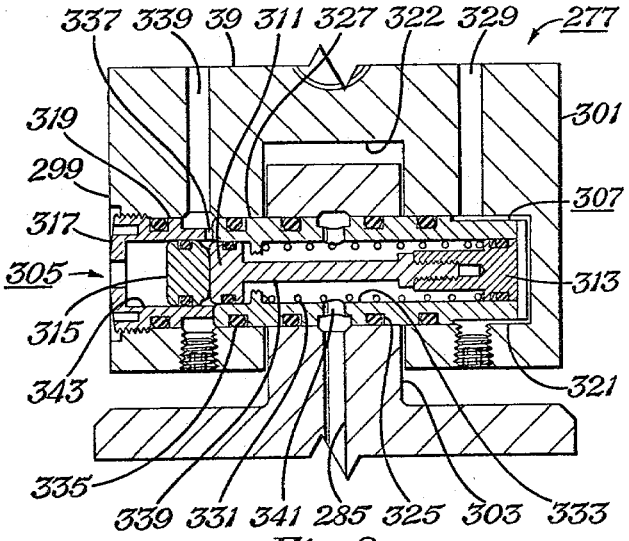
FIG. 8 is a schematic longitudinal section view showing the sample chamber seal valve incorporated in a pivot joint in accordance with a preferred embodiment of the invention.

As hereinbefore stated, the lower tool section 19 is pivotally connected to the upper tool section 17 so as to provide limited relative pivoting movement about an axis 21 which is normal to the direction of travel of the seal pad 13 and backup pads 15 when they are being extended or retracted. The pivot assembly 277 (see FIG. 8) comprises first and second upper tool section pivot bearing protrusions 299, 301, a lower tool section pivot bearing protrusion 303, and a formation sample chamber seal valve assembly 305 which comprises a seal valve body 307, a piston rod 309 having first and second pistons 311, 313 carried on its opposite ends, a bias spring 331, a third piston 315, and a retainer cylinder 317.

The first and second upper tool section pivot bearing protrusions 299, 301 are integral with and extend downwardly from the lower end of the pad block 39 in parallel juxtaposed relation and have respective coaxial transverse bores 319, 321 of equal diameter. The lower tool section pivot bearing protrusion 303 is integral with and extends upwardly from the upper end of the bleed off sub 267 and into the slot 322 formed between the first and second protrusions 299, 301. The lower tool section pivot bearing protrusion 303 has a transverse bore 325 coaxial with and of the same diameter as the respective bores 319, 321 of the first and second protrusions 299, 301. These transverse bores form the bearing box or bearing surfaces for the pivot pin or journal of the pivot assembly 277, which in the embodiment shown, is the seal valve body 307.

The seal valve body 307 has a cylindrical exterior surface 327 that is sealingly and matingly received within the transverse bores 319, 321, 325. The transverse bore 321 of the second bearing protrusion 301 does not extend all of the way through the protrusion, and a chamber is formed at the inner end portion of the seal valve body 307 which communicates with a hydraulic fluid flow passage 329 in the pad block 39.

The retainer cylinder 317 threadedly and sealingly engages the outer portion of the transverse bore 319 and has a cylindrical interior portion 343 which matingly and sealingly engages the third piston 315. The seal valve body 307 has a first cylindrical interior surface 333 that matingly and sealingly receives the second piston 313 and a second cylindrical interior surface 335 of smaller diameter that matingly and sealingly receives the first piston 311. Fluid passage means 337 is provided at the inner end portion of the retainer cylinder to communicate with a formation fluid flow passage 339 in the pad block 39. Another fluid passage means 341 is provided in the seal valve body 307 to communicate between the valve body interior and a formation fluid flow passage 285 in the bleed off sub 267.

Figure 9:
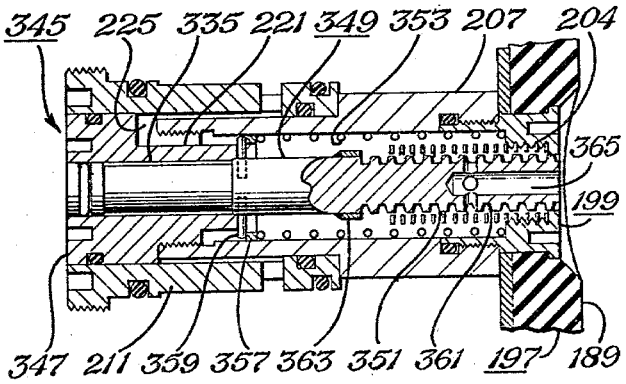
FIG. 9 is a schematic longitudinal section view showing a sand screen device in accordance with a preferred embodiment of the invention.

When the tool 11 is operated in a borehole where unconsolidated formations may be encountered, the sand screen assembly 345 shown by FIG. 9 is utilized. To install the sand screen assembly 345, the sealing pad piston plug 209 (see FIG. 6) is removed and the sand screen assembly 345 is inserted in the cavity made up of the cylindrical bore 202 of the sealing pad retainer 109, the cylindrical central bore 210 of the sealing pad piston 207 and the space vacated by the piston plug 209.

The sand screen assembly 345 comprises a sand screen plug 347, an elongated piston shaft 349, a sand screen spring 351 and a bias spring 353. The sand screen plug 347 is like the sealing pad piston plug 209 that it replaces, except that the sand screen plug 347 has a central bore 355 for matingly and sealingly receiving the outer portion of the piston shaft 349 for reciprocable movement therein. The outer end face of the piston shaft 349 is thus exposed to the well bore when the tool 11 is in operation. The inner end portion of the piston shaft 349 is received by the outer end bore of the sealing pad retainer 199, so that the outer end face of the piston shaft 349 can move into abutting relation with the earth formation being tested when the tool 11 is in operation. The bias spring 353 bears at one end on a shoulder formed at the juncture of the sealing pad retainer cylinder bore 202 and the threaded intermediate bore 204, and at the other end on a ring 357 which is held against outward movement by roll pins 359 carried by the piston shaft 349. When the bias spring 353 is relaxed, the piston shaft 349 is positioned such that its outer end is flush with the outer face of the sand screen plug 347. The sand screen spring 351 is a spirally wound spring having numerous turns that are normally separated sufficiently to permit flow of formation fluids as well as sand therethrough. The inner diameter of the sand screen spring 351 mates loosely with the exterior surface of the piston shaft 349 and the sand screen spring is secured at its inner end by threading onto the threaded intermediate bore 204 of the sealing pad retainer 199. The sand screen spring 351 typically may have fifty turns in about $1\frac{1}{2}''$ of length when relaxed and shortens to about $1\frac{1}{8}''$ when fully compressed. The piston shaft 349 is provided passage means (shown as spiral flutes 361) communicating between the outer end face of the piston shaft 349 and its exterior surface along the length of the sand screen spring 351 and a short distance (typically about $\frac{1}{4}''$) beyond the inner end of the sand screen spring 351. Abutment means, shown as a collar 363, is fixed to the piston shaft 349 adjacent the inner end of the passage means 361, for engaging the sand screen spring 351 upon predetermined movement of the piston shaft 349 outwardly toward the earth formation. Passage means 365 are provided between the outer end face of the piston shaft 349 and the spiral flutes 361. The inner and outer end faces of the piston shaft 349 have equal diameters, so that the piston shaft 349 will not move as the tool 11 is being traversed into the borehole, since well bore fluid pressures on the end faces of the piston 349 are balanced.

When the tool 11 has reached the test site and the sealing pad assembly 189 has been extended and set in sealing engagement with the formation and the volume of the mini-sample chamber 159 has been expanded, then the pressure force on the inner face of the piston shaft 349 will be less than that on the outer face, so that the piston shaft 349 will be continually urged into contact with the formation. Initially, the turns of the sand screen spring 351 will be separated and formation fluid including sand can pass through the turns of the sand screen spring 351 and also through the space between the outer end of the sand screen spring 351 and the inner end of the collar 363. As the unconsolidated formation is eroded, the piston shaft 349 moves inwardly so that the inner end face of the collar 363 abuts the outer end of the sand screen spring 351 and compresses same. The sand screen spring 351 will not fully compress because of sand particles that become trapped between the spring turns. Thus, eventually, the only flow path from the formation via the piston shaft passage means 365 to the interior of the sealing pad piston 207 is between the compressed turns of the sand screen spring 351. Since no more sand pass between the turns of the sand screen spring 351, the formation ceases to erode and only formation fluid is passed through the sand screen spring. When the formation test is completed and well bore fluid pressure again acts on the inner end of the piston shaft 349, the pressure forces on the ends of the piston shaft 349 will again be balanced, allowing the bias spring 353, which was compressed by movement of the piston shaft 349 inwardly, to move to its relaxed position, returning the piston shaft 349 to its original position. As the piston shaft 349 returns toward its original or initial position, the turns of the sand screen spring 351 are wiped by the spiral flutes 361 to clean off the sand particles.

Figure 2:
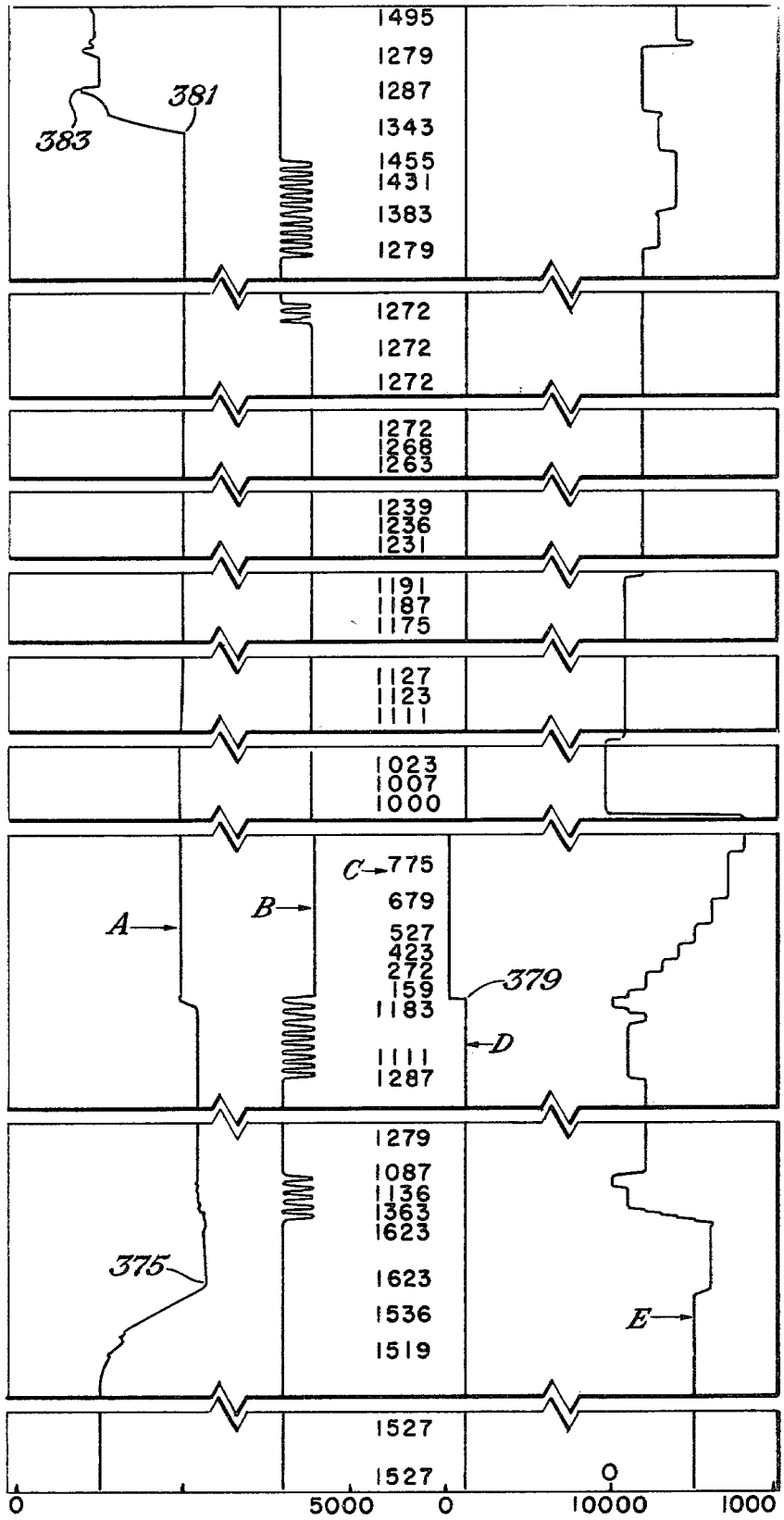
FIG. 2 is a schematic showing of information that may be produced by a strip chart recorder during operation of the tool.
Figure 3:
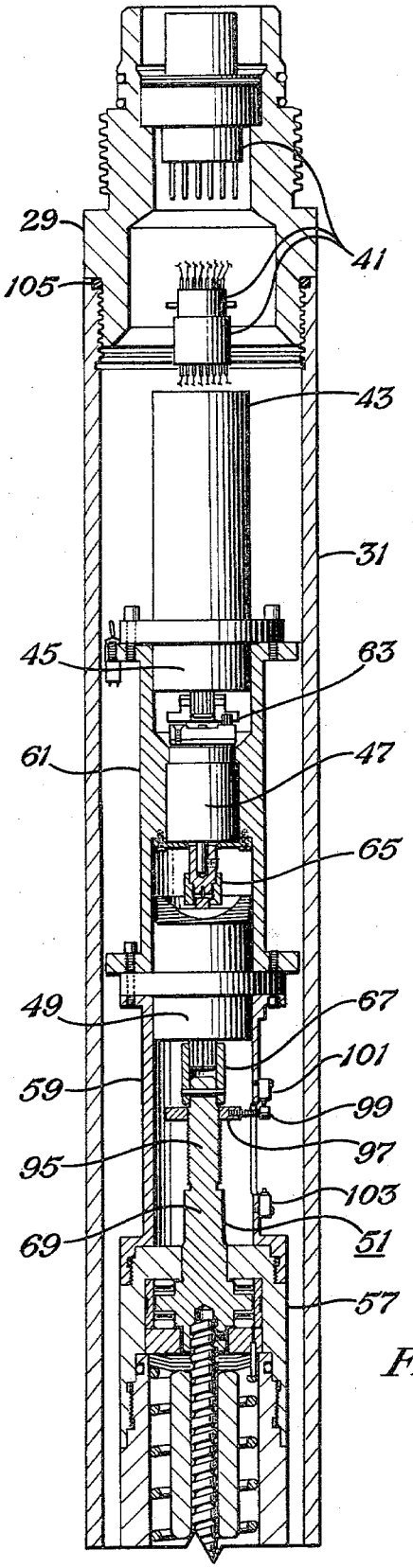
FIGS. 3–7 are schematic longitudinal section views which, when joined end to end consecutively, show from top to bottom the makeup of a tool in accordance with a preferred embodiment of the invention.
Figure 4:
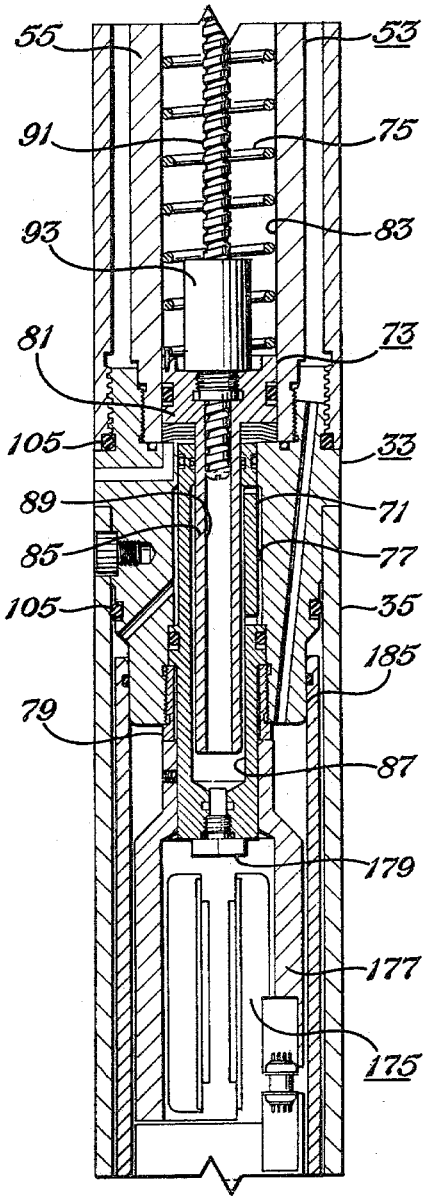
Figure 5:
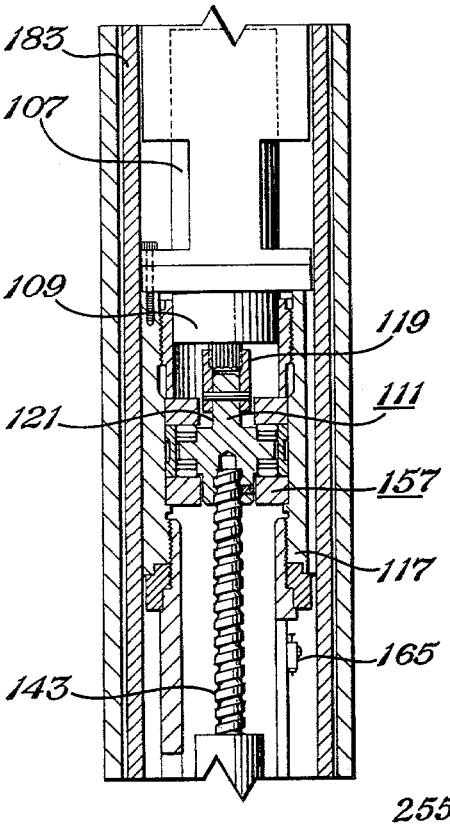
Figure 6:
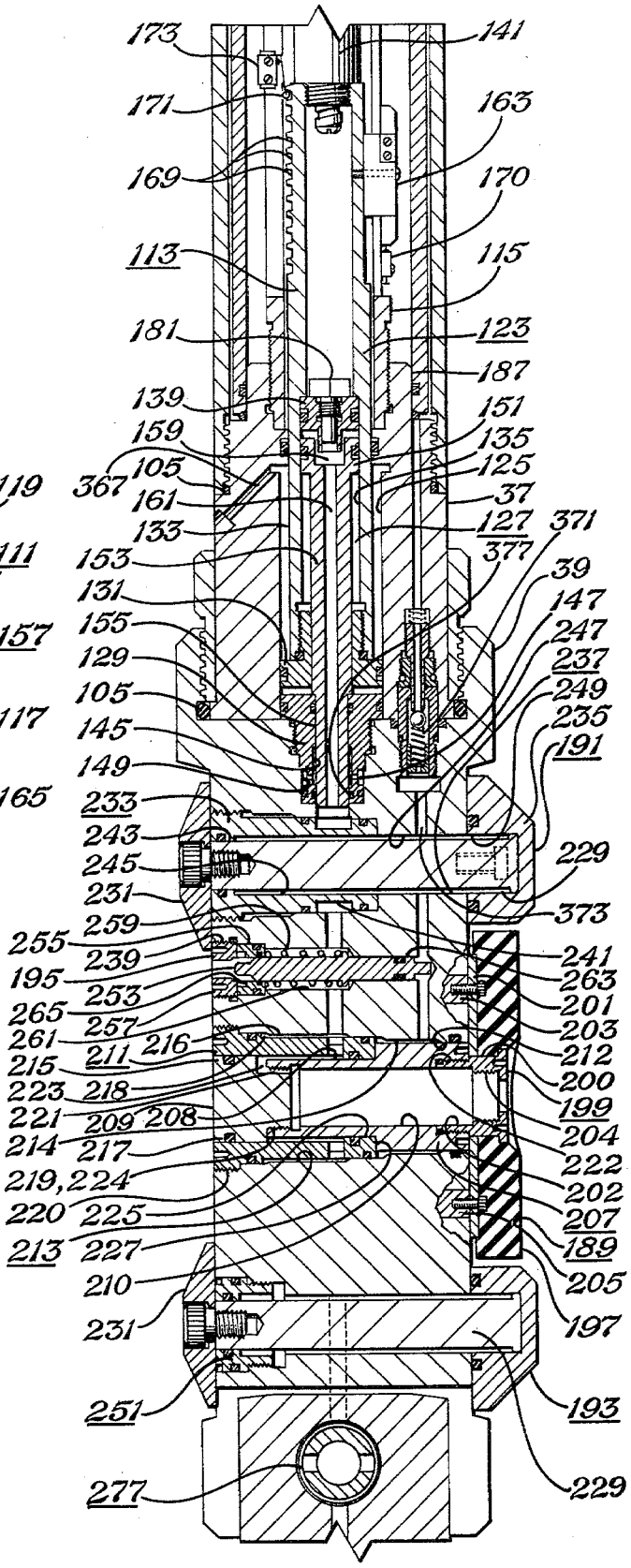

It will be convenient to describe the operation of the tool 11 with reference to FIG. 2 which schematically presents certain information that is produced by a strip chart recorder and is observed by the operator at the above-ground equipment location during operation of the tool.

In FIG. 2, the trace A represents hydraulic pressure sensed by hydraulic fluid pressure sensor 179 on a scale of 0–5,000 p.s.i. The trace B represents the pulses produced each time the cam actuator 171 traverses a cam notch 169. In the embodiment shown, each pulse represents a two c.c. volume increment of mini-chamber 159 volume. The digital printout column C shows in p.s.i., at predetermined time intervals (typically 5 seconds), the pressure sensed by formation fluid pressure sensor 181. Trace D represents the pressure sensed by the formation fluid or hydrostatic pressure sensor 181 on a scale of 0–10,000 p.s.i.; while trace E represents the pressure sensed by the formation fluid pressure sensor 181 on a scale from 0–1,000 p.s.i.

As the tool 11 is run into the borehole, all parts are in the positions shown by FIGS. 3–7. When the tool 11 is stopped at the depth of the earth formation to be tested, the operator energizes the setting motor 43 for rotation in the direction to cause ball nut 93 to move upwardly, bringing with it the setting piston 73. As the setting piston 73 moves upwardly, hydraulic fluid is forced out of the primary cylinder 55 and via various fluid passage means to the interior of the sealing pad piston 207 and the interiors of the upper and lower backup pad assemblies 191, 193, thus causing the sealing pad 197 and the backup pads 231 to be extended into contact with the wall of the well bore. This hydraulic fluid flow path can be traced from the interior of the primary cylinder 55 through the ball nut 93, through the setting piston central bore 89 to the interior of the secondary cylinder 71 and via a passage 367 to the space between the lower pressure jacket 35 and the inner cylinder jacket 183 to a hydraulic fluid pressure passage 369 in pad block sub 37 and through a connector valve assembly 371 to a hydraulic fluid passage 373 in pad block 39. This hydraulic fluid flow path is isolated by means of various o-ring seals. When the hydraulic fluid pressure reaches a value which is about 1,500 p.s.i. above the well bore pressure, then the sealing pad 197 is considered to be set, thus isolating the formation at the sealing pad location. In FIG. 2 it can be seen that this event occurs at the point 375 of trace A and at a readout of about 1,623 pounds on trace C. When the point 375 is observed by the operator, he de-energizes setting motor 43.

Next, the operator energizes the mini-sample motor 107 for rotation in the direction to cause ball nut 141, and consequently primary piston structure 123, to move upwardly. Upward movement of the primary piston structure 123 causes the volume of mini-sample chamber 159 to begin to increase. The mini-sample chamber communicates with the formation being tested at the seal pad location via passage means which can be traced from the mini-sample chamber 159 through the floating piston fluid passage 161 to the circumferential groove 241 in seal plug 233, through a passage in the block 39 to the pad block bore 261 for the equalizer valve assembly 195 and through a further passage in pad block 39 to the third cylindrical portion 216 of the pad block central transverse bore 213 and through openings in the wall of sealing pad cylinder 211 and through bores 223 and sealing pad piston plug 209 and the grooves 221 in threaded cylinder portion 219 of sealing pad piston plug 209 to the interior of the sealing pad piston 207 which is exposed to the earth formation at the sealing pad location. This formation fluid path is isolated by means of various o-ring seals, so long as the equalizer valve 195 is closed.

The pressure forces acting on the upper end of the floating piston 127 are always greater than those acting on its lower end because of unequal surface areas, and consequently the floating piston is always urged downwardly by the differential pressure forces. Thus, the floating piston 127 remains in its extreme downward position as the primary piston structure 123 is moved upwardly. In the example shown by FIG. 2, the operator permits the primary piston structure 123 to move upwardly until five pulses have been generated on trace B, showing that the mini-sample chamber volume 159 has increased to 10 cc. Observing trace E of FIG. 2, it will be seen that the fluid pressure in the mini-sample chamber 159, as sensed by the formation fluid pressure sensor 181 rapidly decreases as the mini-sample chamber volume is increased. As seen by the pressure readout in column C, the mini-sample chamber pressure has decreased from 1,623 p.s.i. to 1,087 p.s.i. and soon thereafter increases and stabilizes at about 1,279 p.s.i. (see also trace E). This is the "shut-in" pressure of the formation being tested.

It will be observed that it was only necessary for the operator to open the mini-sample chamber sufficiently to cause the pressure therein to drop to a point considered to be below the likely formation shut-in pressure and then de-energize the mini-sample motor 107 and wait for the mini-sample chamber pressure to build up and stabilize, at which point the formation "shut-in" pressure will have been reached. When the formation being tested has a low permeability, only a small amount (perhaps only 2 c.c.) of formation fluid need be drawn into the mini-sample chamber to achieve formation "shut-in" pressure. If it were necessary to wait for a large test sample chamber to fill before formation "shut-in" pressure is achieved, this could take a long time in the case of low permeability formations. An important feature of the present invention is the provision for a variable volume mini-sample chamber which can be monitored at aboveground equipment and controlled at the will of an operator.

Next, the mini-sample motor 107 is again energized in the direction to continue upward movement of the ball nut 141 and consequently the primary piston structure 123, generating a second series of pulses on trace B of FIG. 2. After a predetermined upward movement of the primary piston structure 123, a shoulder on the upper end of piston head portion 131 engages a shoulder on the lower side of the head portion 151 of the floating piston 127, forcing the floating piston 127 to move upwardly away from seal means 377 to open a flow passage from the floating piston fluid passage 161 to the groove 147 in the flow line valve body 129 and through passage means including fluid flow passage 339 in the pad block 39 and via the seal valve 305 and a further formation fluid flow passage 285 in the bleed off sub 267 and through the bleed off valve 283 and further fluid flow passage 285 into the formation sample chamber 269.

It should be noted (see FIG. 8) that the sample chamber seal valve 305 is normally urged to its closed position under the force of bias spring 331 because the second and third pistons 313, 315 have the same diameter and are exposed to well bore pressure. The piston 313 is exposed to hydraulic fluid via the hydraulic fluid flow passage 329. The piston 313 is subjected to hydraulic fluid pressure generated by the action of the setting motor 43 and consequently the piston rod 309 and first piston 311 are moved outwardly to open the seal valve 305 thus permitting formation to flow from passage 339 to the interior of the seal valve body 307. The equalizer valve inner end face is also subjected to hydraulic fluid pressure generated by the action of the setting motor 43 and is moved to the closed position by such hydraulic fluid pressure.

The opening of the formation fluid flow line (upon sufficient upward movement of floating piston 127) results in a drastic pressure drop within the mini-sample chamber as sensed by the formation fluid pressure sensor 181. This event is observed by the operator at point 379 on trace A and also in the pressure readout column C where the pressure reading suddenly drops from 1,183 p.s.i. to 159 p.s.i. At this point, the operator stops the mini-sample motor 107 (or it is stopped by a limit switch) and waits for the formation sample chamber 269 to fill. As the formation sample chamber 269 is filled, the formation pressure readings (in column C of FIG. 2) gradually increase until the formation "shut-in" pressure is again reached (when the column C readouts show about 1,272 p.s.i.). After the formation "shut-in" pressure has again been reached, indicating that the formation sample chamber 269 is full, the operator again energizes mini-sample chamber motor 107 to rotate in the reverse direction, thus moving the primary piston structure 123 downwardly, permitting the floating piston 127 to move downwardly to its lower most position, thus closing the formation fluid flow passage through the flow line valve body 129. Then, downward movement of the primary piston structure 123 is continued in order to expel the formation sample fluid from the mini-sample chamber 159. The operator, monitors the volume condition of the mini-sample chamber 159 by watching the series of pulses on trace B of FIG. 2.

Next, the operator energizes the setting motor 43 in the reverse direction to cause the setting piston 73 to move downwardly, increasing the volume of the primary cylinder 55 thus reducing the hydraulic fluid pressure. This hydraulic fluid pressure reduction permits the equalizer valve 195 to open, and the seal valve 305 to close. Thus, the formation sample chamber 269 is sealed. Also, well bore fluid is admitted to the interior of the sealing pad piston 207 and consequently onto the formation at the sealing pad location, which results in equalization of pressures on the sealing pad 197 causing it to release its contact with the formation. Differential pressures on the sealing pad assembly 189 and the upper and lower backup pad assemblies 191, 193 cause them to retract to their running in positions. The rapid reduction in hydraulic pressure resulting from the reversing of the setting motor 43 may be noted on trace A of FIG. 2 between the points 381 and 383. The operator can also notice from column C of FIG. 2 that the equalizer valve has opened when the pressure readout returns to normal well bore pressure (at about 1,495 p.s.i.).

It should be noted that the herein disclosed arrangement of mini-sample apparatus makes it possible to open and close the flow line path at the flow line valve body 129 and vary the volume of the mini-sample chamber 159 independently of any other function of the tool 11. This makes possible certain operator options. First, as hereinabove mentioned, the waiting time for achieving formation "shut-in" pressure can be greatly reduced. Second, the formation fluid flow line can be opened and re-closed during a sample test in order to unplug the flow path by injecting fluid in the mini-sample chamber 159 back through the system and into the formation at the seal pad location. Third, a formation "shut-in" pressure test can be performed at any time either while the formation fluid sample chamber 269 is being filled, or thereafter, by closing the formation flow line passage at the flow line valve body 129. Further, all of the functions above-mentioned can be performed independently of the sealing pad setting function.

I claim:

1. A tool for testing earth formations in boreholes, comprising:

formation isolation means including hydraulically controlled extendable and retractable seal pad means and backup pad means;

first electrically powered means controllable at aboveground equipment for generating and applying setting pressure to extend and set said seal pad means and said backup pad means to accomplish isolation of the formation at the seal pad location;

means for generating first signals to be transmitted to aboveground equipment, which signals are a measure of said hydraulic pressure;

a formation fluid mini-sample chamber having variable volume, and fluid passage means for communicating between said mini-sample chamber and the formation at said seal pad location;

second electrically powered means controllable at aboveground equipment to vary at the will of an operator the volume of said mini-sample chamber;

means for generating second signals to be transmitted to aboveground equipment, which second signals are a measure of fluid pressure within said mini-sample chamber; and means for generating third signals to be transmitted to aboveground equipment, which third signals are a measure of the volume of said mini-sample chamber.

2. The tool of claim 1, wherein:

said second electrically powered means comprises a reversible electric motor coupled through a gear reduction to a ball screw and ball nut;

said variable volume mini-sample chamber comprises a cylinder having a sealed upper end and being movable with said ball nut;

a formation sample chamber is incorporated in said tool;

a floating piston is disposed within said cylinder and is pressure biased to normally close fluid passage means communicating between the formation at said seal pad location and said formation sample chamber;

and means are provided to move said floating piston upwardly to open said last mentioned fluid passage means upon a predetermined upward movement of said cylinder.

* * * * *